US006401818B1

(12) United States Patent
Papanastasiou

(10) Patent No.: US 6,401,818 B1
(45) **Date of Patent: *Jun. 11, 2002**

(54) WELLBORE PERFORATION METHOD AND APPARATUS

(75) Inventor: Panos Papanastasiou, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/579,587

(22) Filed: May 26, 2000

Related U.S. Application Data

(63) Continuation-in-part of application No. 09/321,040, filed on May 27, 1999, now Pat. No. 6,283,214.

(30) Foreign Application Priority Data

Nov. 15, 1999 (GB) ..... 9926798

(51) Int. Cl.[7] ..... E21B 43/118

(52) U.S. Cl. ..... 166/297; 166/55.2; 175/4.51; 175/4.6; 102/313

(58) Field of Search ..... 166/297, 55, 55.2; 175/4.51, 4.6; 102/306, 313

(56) References Cited

U.S. PATENT DOCUMENTS 3,580,338 A * 5/1971 Sparlin

FOREIGN PATENT DOCUMENTS

| | | |
|---|---|---|
| GB | 701074 | 12/1953 |
| GB | 828306 | 2/1960 |
| GB | 833164 | 4/1960 |

* cited by examiner

*Primary Examiner*—Roger Schoeppel
(74) *Attorney, Agent, or Firm*—William L. Wang; Thomas O. Mitchell

(57) ABSTRACT

A method and apparatus is described for increasing hydrocarbon production from a production well by determining a bedding plane (permeability anisotropy) of a hydrocarbon bearing formation and using a perforating tool to form in the formation holes having an essentially elliptical or elongated cross-section with the longest axis of said elliptical or elongated cross-section oriented perpendicular to said bedding plane (or in direction of the lowest permeability).

16 Claims, 6 Drawing Sheets

WELLBORE PERFORATION METHOD AND APPARATUS

RELATED APPLICATION

The present invention is a continuation-in-part of the U.S. patent application Ser. No. 09/321,040, filed May 27, 1999 now U.S. Pat. No. 6,283,214.

FIELD OF THE INVENTION

The present invention relates to novel devices and methods to optimize the production of hydrocarbons from subterranean reservoirs.

BACKGROUND OF THE INVENTION

One of the first steps in oil and gas production is drilling a wellbore into the hydrocarbon-bearing formation. Next, a casing (liner), generally steel, is inserted into the wellbore. Once the casing is inserted into the wellbore, it is then cemented in place, by pumping cement into the gap between casing and borehole (annulus). The reasons for doing this are many, but essentially, a liner helps ensure the integrity of the wellbore, i.e., so that it does not collapse; another reason for the wellbore liner is to isolate different geologic zones, e.g., an oil-bearing zone from an (undesirable water-bearing zone). By placing a liner in the wellbore and cementing the liner to the wellbore, then selectively placing holes in the liner, one can effectively isolate certain portions of the subsurface, for instance to avoid the co-production of water along with oil.

That process of selectively placing holes in the liner and cement so that oil and gas can flow from the formation into the wellbore and eventually to the surface is generally known as "perforating." One common way to do this is to lower a perforating gun into the wellbore using a wireline, slickline, or coiled tubing to the desired depth, then detonate a shaped charge mounted on the main body of the gun. The shaped charge creates a hole in the adjacent wellbore liner and formation behind the liner. This hole is known as a "perforation". U.S. Pat. No. 5,816,343, assigned to Schlumberger Technology Corporation, incorporated by reference in its entirety, discusses prior art perforating systems (e.g., col. 1., 1. 17).

In the U.S. patent application Ser. No. 09/321,040, filed May 27 1999, and assigned to Schlumberger Technology Corporation, a method and apparatus is disclosed for minimizing the sand production from a wellbore by generating essentially elliptically shaped perforations. It was found that a particular shape and orientation of the perforation minimizes the destabilization of sand formations, hence also minimizes sand production. As a particular example, elliptically shaped perforations having the major axis of the ellipses aligned in the direction of maximum compressive stress, improve the stability of the formation in the region near the wellbore, hence can minimizing sand intrusion.

One of the co-inventors of the above-identified patent application now found that essentially elliptically shaped perforations have a potentially beneficial, i.e., a maximizing effect on the production of hydrocarbons from a producing well, when properly oriented with respect to the surrounding formation.

SUMMARY OF THE INVENTION

In accordance with the present invention, there is provided a method and apparatus for increasing hydrocarbon production from a production well by determining a bedding plane or permeability anisotropy of a hydrocarbon bearing formation and using a perforating tool to form in the formation holes having an essentially elliptical or elongated cross-section with the longest axis of said elliptical or elongated cross-section oriented perpendicular to said bedding plane or in the direction of the lowest permeability.

Permeability, which expresses the ease with which fluids flow through rock, varies in general with the direction in which it is measured. This property, often called rock anisotropy, arises at the bedding scale during deposition, grain alignment and packing. The permeability distribution that governs the fluid flow in rocks will result in fluid movement dominated by a horizontal flow.

By creating drain-holes or perforations with greater exposure to the horizontal flow than to the vertical flow, such as elliptical perforations with long axis vertical, a higher productivity can be expected. Although large flow-rates are encountered near the tips in conventional perforations the flow rates through the main body of the perforations are still significant.

Large anisotropies are observed in many formations. Typical measured ratio of horizontal-to-vertical permeability range from 10 to 100 times. Examples are known where lamination of shales in a sandstone matrix results in a ratio of 170 the reason being that shales have small grain size and extremely low permeability. Therefore, the permeability is significantly lower across the sand bed boundaries than within the sand beds. In clean sandstone a permeability anisotropy ratio of 276 has been reported. In this case the permeability anisotropy was caused by variation in grain size and packing. Therefore the perforation of laminated sand-shale formations, in which each layer may have a thickness of 5 cm or less, is a particular concern of the present invention.

Permeability anisotropy can be measured with different methods such as core analysis, well testing or logging techniques (dip meter, micro imagers based on acoustic or resistivity measurements, etc.). More recently a technique for measuring vertical and horizontal permeability uses a multi-probe wireline formation tester in open hole before the completion is run. This technique allows the completion engineers to choose the optimum completion method including a suitable perforation strategy for optimizing productivity.

In a preferred embodiment, the holes are formed using a discharge-type perforation tool. Preferably the perforation tool is creating the perforation in one operational step, i.e., cutting through the casing and the formation without interruption or retrieval of the tool.

Discharge-type perforation tools include perforation guns and jet cutting tools. The latter discharge a fluid jet usually loaded with additional abrasives. With a jet cutting tool, a slit hole is cut into the formation using either guided nozzles, or a suitably arranged set of nozzles or specifically shaped nozzles. Jetting cutting tools as such are known and have been used in the oilfield industry for well cleaning applications, e.g. U.S. Pat. Nos. 4,349.073 and 5,337,819 and the U.K. Patent Application No. GB 2,324,818 A.

However more effective discharge-type perforation tools are likely to be perforation guns using shaped charges as described for example in U.S. Pat. Nos. 5,421,419 and 5,337,819.

For the purpose of the present invention, modifications have to be made as to the design or deployment of such guns. The modification may include using conventional symmetrical shaped charges which produces circular holes but tilting the direction of the perforation hole with regard to the bedding plane. To implement this embodiment of the invention the shaped charges may have to be mounted at an angle of less than ninety degrees for the tool's main axis. Another modification to conventional gun designs includes the use of charges with no rotational symmetry, specifically shaped charges with an elliptical cross-section as described herein below.

In the earlier U.S. patent application Ser. No. 09/321,040, filed May 27, 1999, incorporated herein by reference, elliptical perforations are described to be stronger than conventional circular perforations thus allowing for greater drawdown pressure and depletion before failure of the perforation due to sand production. The new invention does not contradict the use of elliptical perforations for sand prevention because in most cases, for both sand prevention and maximum productivity, the elliptical perforations have to be oriented in the same way. Hence it is perfectly feasible to achieve an increased production and lower risk of failure using the tools and methods described herein.

In addition, the present invention can be used in strong rock formations where the sanding risk is not a problem, simply for maximizing the productivity.

These and other features of the invention, preferred embodiments and variants thereof, possible applications and advantages will become appreciated and understood by those skilled in the art from the following detailed description and drawings.

DRAWINGS

Figure 4A:
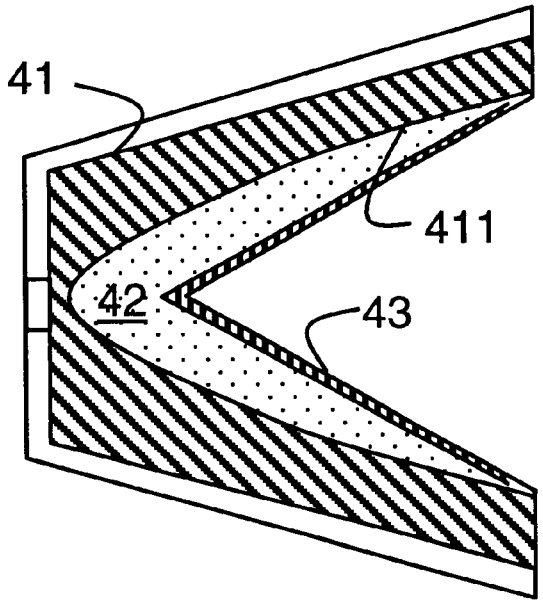
Figure 5A:
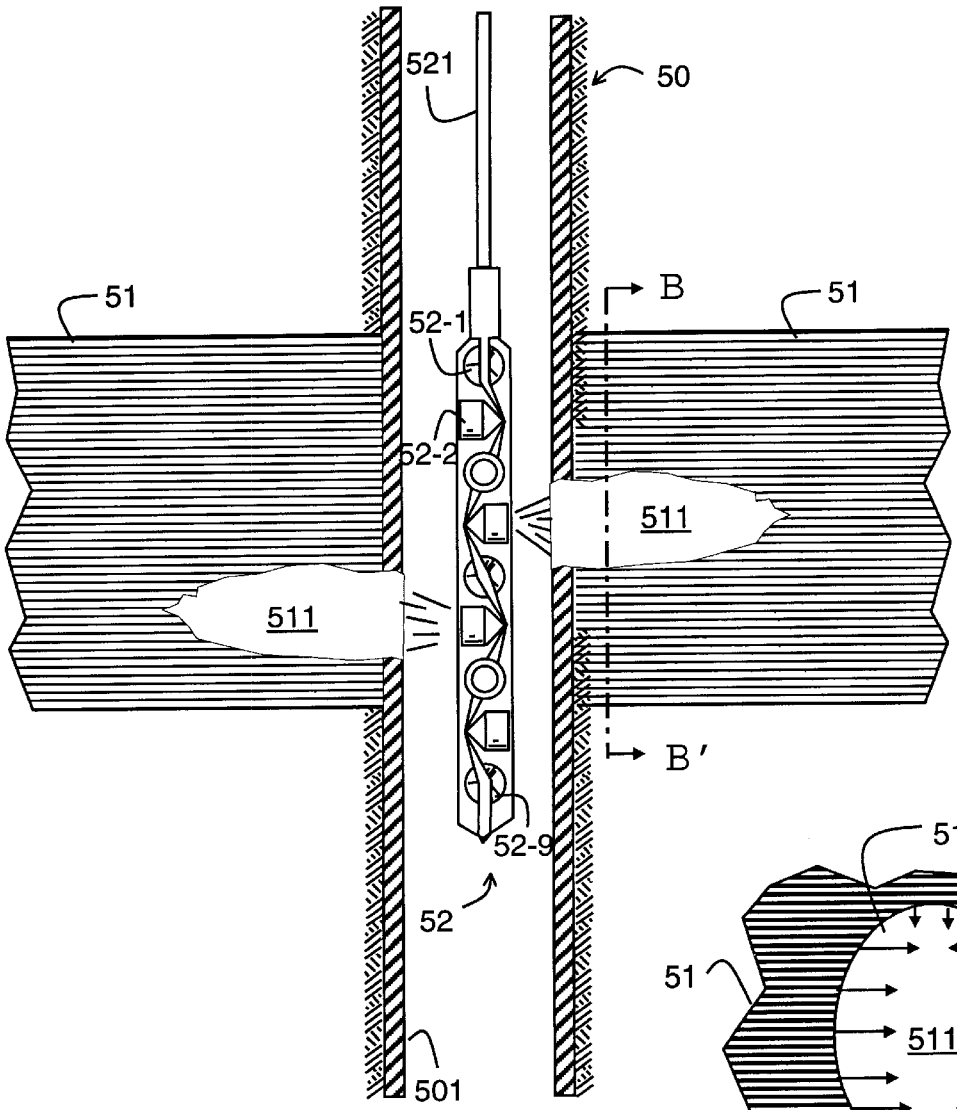
Figure 5B:
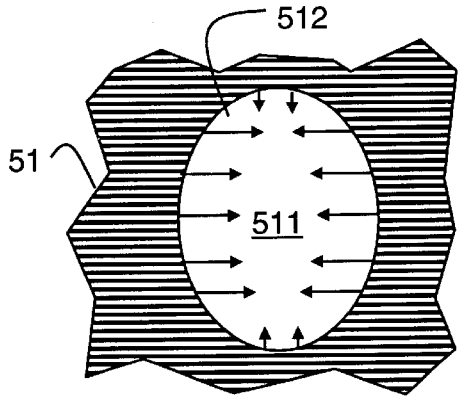
Figure 6:
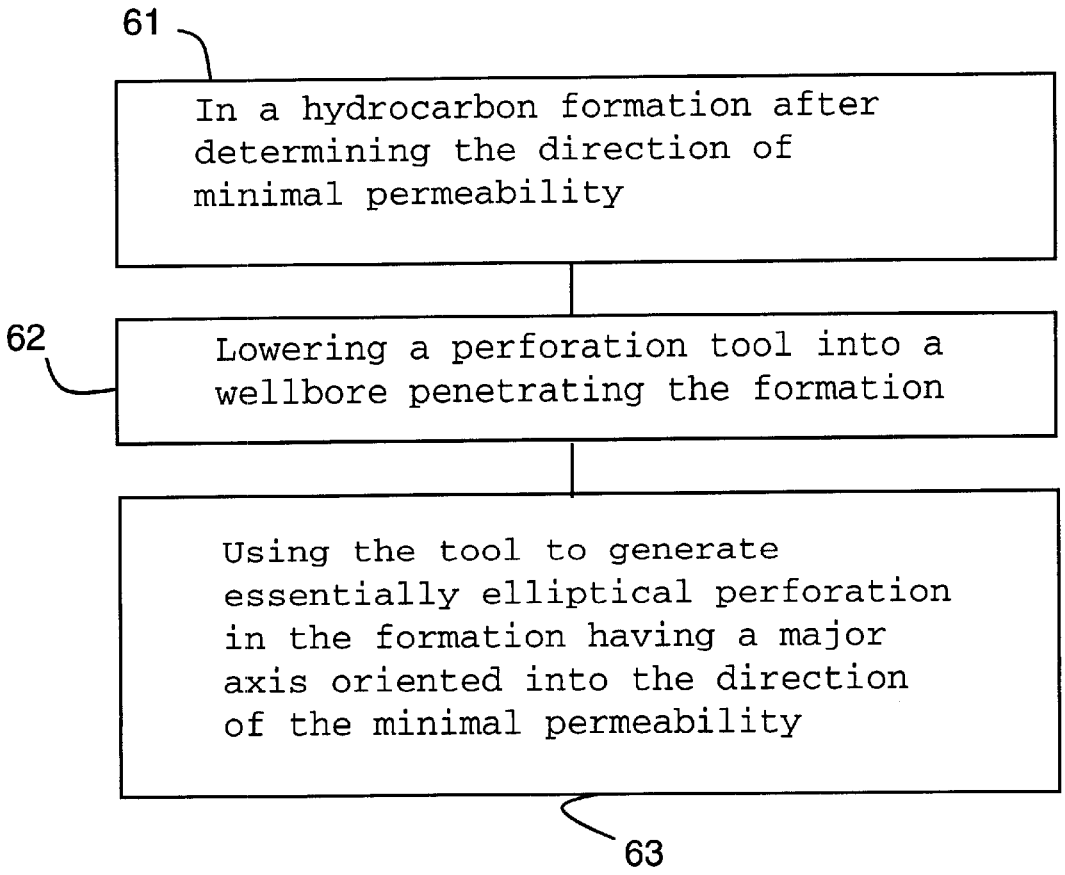

FIGS. 4A, B are (perpendicular) cross-sections of a shaped charge modified in accordance with an example of the invention;

FIG. 5A is a schematic cross-section showing a second perforation tool according to the invention, using modified shaped charges and suspended in a wellbore adjacent to a horizontally layered oil-bearing formation;

FIG. 5B shows a cross-section along line B–B' of FIG. 5A viewing in direction of the hole; and FIG. 6 illustrates major steps of a method in accordance with an example of the invention.

DETAILED DESCRIPTION OF THE INVENTION

The invention is described using the example of a vertical well penetrating an oil-bearing formation with a layered structure. For the sake of simplicity the layered structure has a horizontal bedding plane. It is assumed (and usually the case) that the bedding plane is the direction with maximal permeability.

Figure 1A:
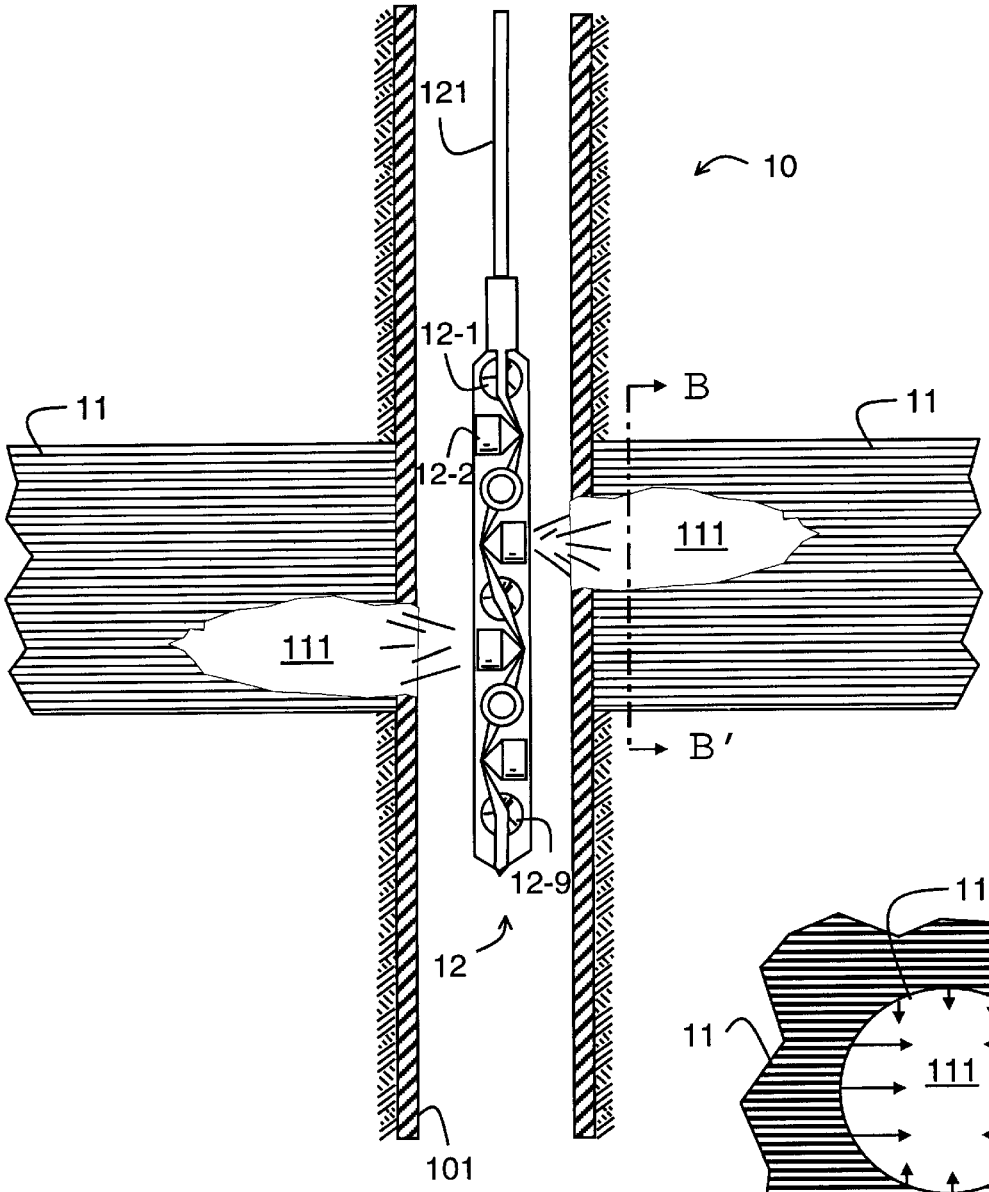
FIG. 1A (Prior Art)
FIG. 1A is a schematic cross-section showing a conventional perforation tool suspended in a wellbore adjacent to a horizontally layered oil-bearing formation.

Referring to FIG. 1, a wellbore 10 is schematically illustrated. The wellbore traverses a hydrocarbon bearing formation 11 and is lined with casing tubulars 101 made of steel.

A perforation gun 12 is shown within the wellbore. The gun is suspended from a wireline 121. The perforation gun comprises a plurality of shaped charges 12-1 to 12-9. The charges are oriented to perforate the casing and the formation in a direction perpendicular to the main axis of the gun 12, i.e., perpendicular to the main axis of the wellbore 10. As a wellbore traverses an oil-bearing formation, usually the formation surrounds the wellbore. Therefore shaped charged are placed at different azimuth angles to ensure that a large part of the oil-bearing formation is perforated in one step. In the example of FIG. 1 adjacent shaped charges are separated by an azimuth angle of 90 degrees.

The hydrocarbon bearing formation 11 is depicted having a thinly layered structure with a horizontal bedding plane, i.e., orientation of the layers. In accordance with the research results cited above, it is assumed that the maximum permeability of the formation is in direction of the layers, i.e., horizontal and that minimum permeability is found perpendicular to the bedding plane, i.e., in a vertical direction.

In operation, the charges 12-1 etc. are detonated. Each detonation generates a deep perforation hole 111 penetrating the casing and parts of the formation 11. As a result, formation fluid can enter through the holes 111 into the wellbore, where it is pumped in a subsequent production stage to the surface.

The method and apparatus as described above is well known and practiced. In the following, the description focuses on the elements that distinguish the present invention over such prior art.

Figure 1B:
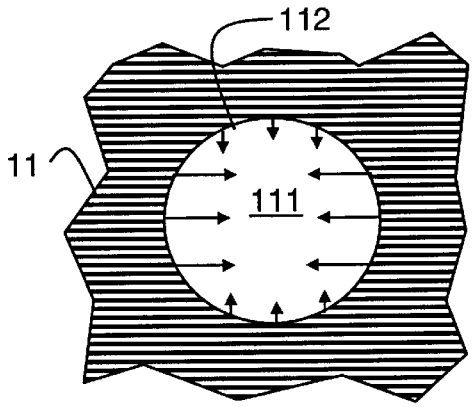
FIG. 1B (Prior Art)
FIG. 1B shows a cross-section along line B–B' of FIG. 1A viewing in direction of the hole.

As FIG. 1 describes the conventional perforation technique, the cross-section of the perforation hole 111 along the line B–B' is depicted as regular circle 112. The true shape of a real perforation may or may not deviate substantially from the circular shape shown. For the scope of the present invention, however, it is important to note that shaped charges and the known perforation guns are designed and arranged to produce such circular perforation pattern. More of this distinction between prior art and the present invention will be discussed below. In FIG. 1B, the circular cross-section is shown with arrows representing the expected flow rate into the perforation and hence into the wellbore.

Since permeability to the sides is assumed to be larger than the contributions from the top or bottom of the perforation, larger horizontal arrows and small vertical arrows are chosen to indicate the flow from those directions.

From FIG. 1B it is apparent that by increasing the size/diameter of the perforation more fluid can be drained from the formation. Therefore, many attempts have been made to increase the size of a hole that a shaped charge can produce. However, the process of increasing the size has its limits. Those limits are mainly set by the stability of the perforation, i.e. of the surrounding rock. As a general rule, the stability of the hole decreases with its increasing diameter. Thus, increasing production by increasing the size of a perforation is a strategy of limited value, which the present invention seeks to overcome.

Referring now to FIG. 2, a first embodiment of the invention is schematically illustrated.

Figure 2A:
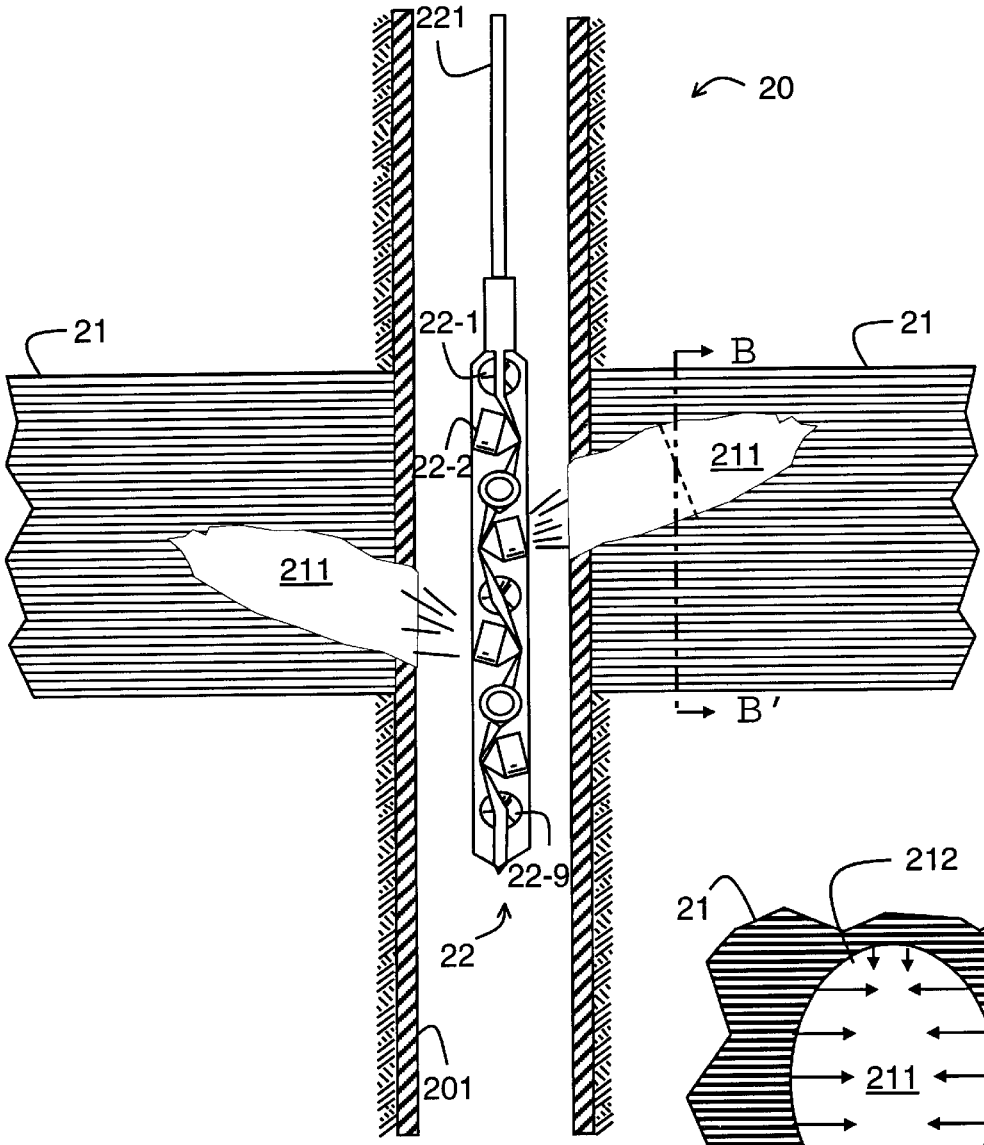
FIG. 2A is a schematic cross-section showing a perforation tool modified in accordance with an example of the invention, the tool being suspended in a wellbore adjacent to a horizontally layered oil-bearing formation.

In FIG. 2A, a modified perforation gun 22 is shown suspended in a vertical wellbore in a manner otherwise identical to FIG. 1.

Again, the gun is shown suspended from a wireline 221. The perforation gun comprises essentially a plurality of shaped charges 22-1 to 22-9. The charges are mounted on the gun frame tilted with respect to the main axis of the tool. Thus the charges perforate the casing 201 and the formation 21 at approximately 45 degrees from the main axis of the wellbore 20. Again the shaped charged are placed at different azimuth angles to ensure that a large part of the oil-bearing formation is perforated in a single detonation step.

Figure 2B:
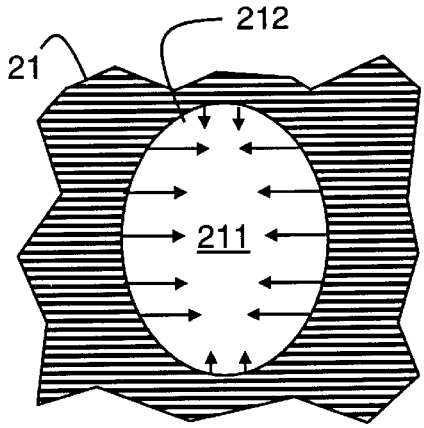
FIG. 2B shows a cross-section along line B–B' of FIG. 2A viewing in direction of the hole.

When activated, the charges generate inclined perforation holes 211 in the formation 21. The inclination of the shaped charges makes the cross-section along the line B—B, that is perpendicular to the bedding plane, appear as an elliptical cut 212 (FIG. 2B).

However the above-described method and tool may be suboptimal as the inclination of the perforation hole results in a reduced depth of the hole. Thus less hydrocarbons may be drawn from the formation at a large distance from the well. Therefore, further examples are described herein below illustrating other methods and apparatus for implementing the present invention.

As an alternative to perforation guns, it is envisaged to employ jet cutting tools. Such tools are frequently used in well cleaning operations to remove scale deposits. Examples are described in the U.K. Patent Application GB-A-2 335 213 and documents referred to therein. For well cleaning purposes, the jet tools are usually designed to avoid damaging the steel tubulars in a well. By selecting proper fluids, abrasives, nozzle arrangements, pressure and other flow conditions conventional well cleaning tool are readily converted into steel cutting tools.

Figure 3A:
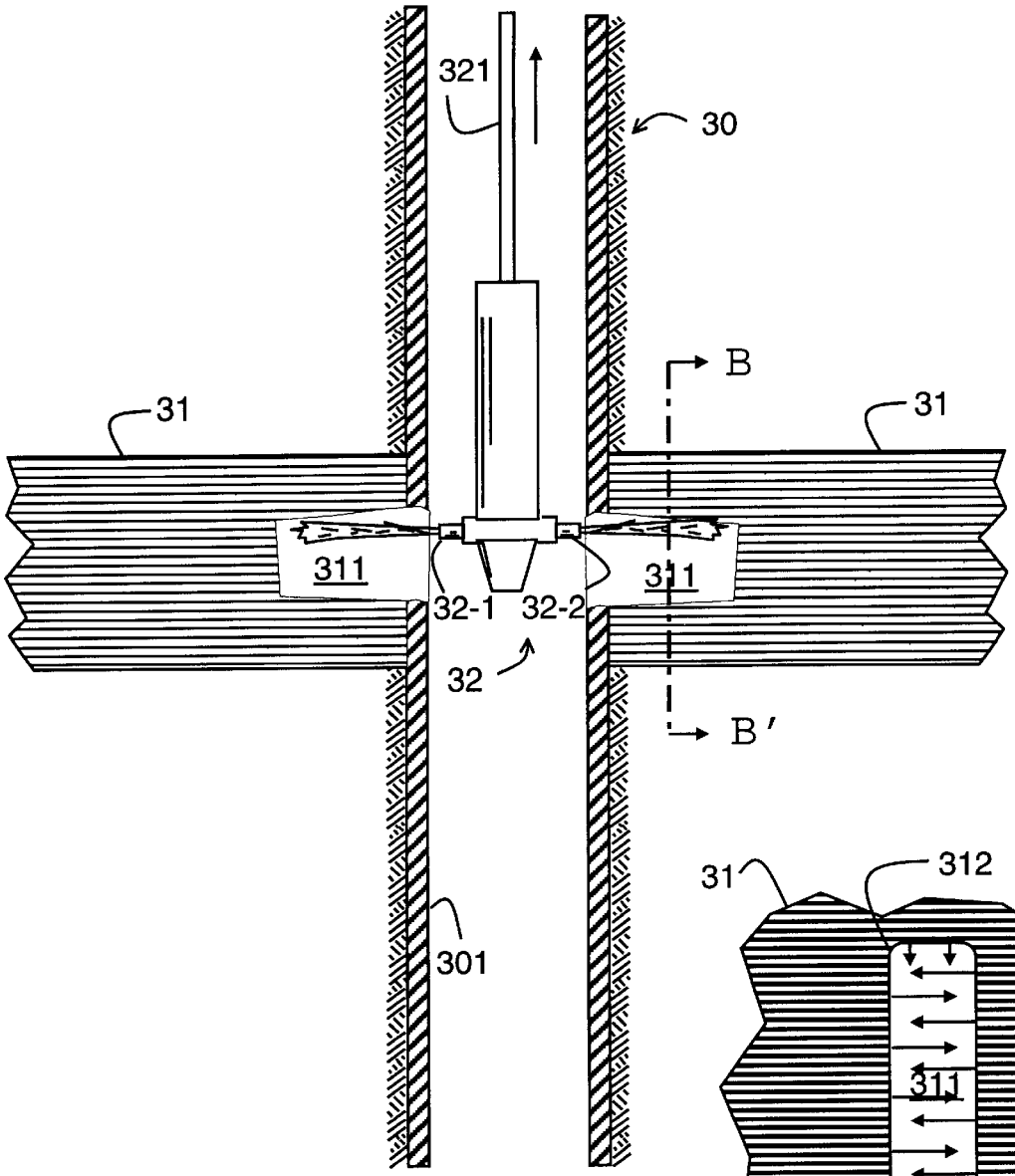
FIG. 3A is a schematic cross-section showing a jet cutting tool used in a accordance with the invention, suspended in a wellbore adjacent to a horizontally layered oil-bearing formation.
Figure 3B:
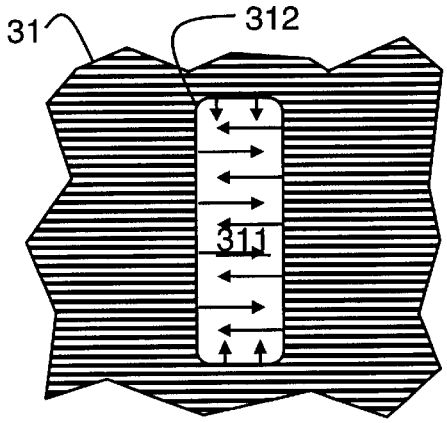
FIG. 3B shows a cross-section along line B–B' of FIG. 3A viewing in direction of the hole.

Referring now to FIG. 3, a jet cutting tool is shown as an exemplary way of implementing the present invention.

In FIG. 3A, a wellbore 30 is schematically illustrated. The wellbore traverses a hydrocarbon bearing formation 31 and is lined with casing tubulars 301 made of steel.

A jet cutting tool 32 is shown within the wellbore 30. The tool is mounted on a coiled tubing 321 through which pressurized fluid is pumped from the surface. The tool comprises nozzles 32-1, 32-2 that are diametrically opposed to each other.

When activating the tool, the fluid loaded with suitable abrasive cuts through the steel tubular 301 and into the formation 31. The cutting action combined with a lowering or lifting movement of the tool leads to the formation of holes 311 having a degenerated ellipsoidal cross-section 312, perhaps better described as rectangular slits. The depth of the hole 311 depends on the fluid characteristics and the speed at which the tool is moved.

The rectangular slits 312 with a small width actually maximize the proportion of highly permeable (side) wall surface versus the low permeability surfaces at the top and bottom of the hole. As in the previous illustrations of the cross-sections of perforation, arrows indicate the flow rate into the perforation hole 311 from various points on the circumference 311.

It is however again a necessary condition to orient the discharge nozzles 32-1, 32-2 such that the cut is made in the direction of the bedding plane or, in other words, in the direction of the lowest permeability. Whereas this can be achieved in the clear horizontal bedding layer by a vertical movement of the nozzle, other orientations of tool axis and bedding plane may require a rotational or a combined translational and rotational movement of the nozzles with respect to the main tool axis.

In the case of a horizontal or near-horizontal wellbore that penetrates into a hydrocarbon bearing formation with a horizontal bedding layer, the nozzles have to move perpendicular to the tool axis in order to generate vertical slits in the side walls. However, even here a movement of the nozzles parallel to the tool axis would generate correctly oriented slits in the top and bottom of the wellbore.

Referring now to FIGS. 4 and 5, a perforation gun with modified shaped charges is schematically illustrated.

Figure 4B:
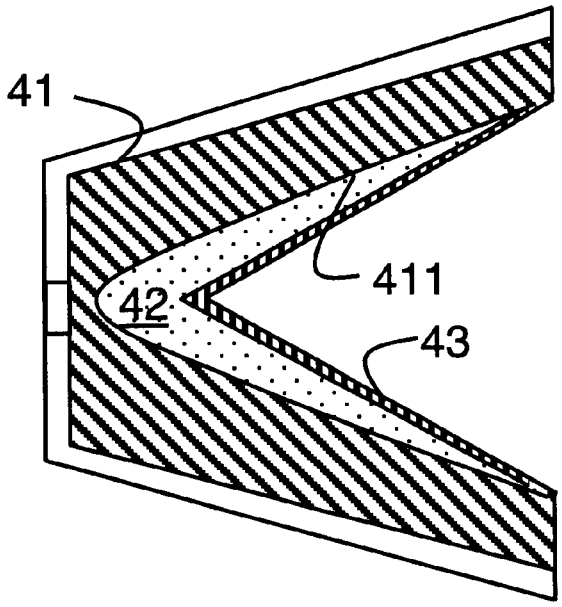

In FIG. 4, there are shown two cross-sections through a shaped charge modified in accordance with the invention. In FIG. 4A the modified shaped charge is seen from the top. In FIG. 4B the modified shaped charge is seen from the side.

The shaped charge 40 consists of three primary components: the housing or case 41, the explosive 42, and the (inner) liner 43.

Given that the explosive material 42 fills the volume between the case 41 and the liner, two methods are envisaged to cause the desired asymmetric distribution of explosive material 42 around the central axis of the charge case 41. One method essentially consists of giving at least the inner surface (as seen from the central axis) of the case or housing 41 the desired shape. The second method essentially consists of giving at least the outer surface (as seen from the central axis) of the liner 43 the desired asymmetry. As both methods generate the same shaped charges, only the former method is illustrated by FIG. 4.

In FIG. 4, the inner surface 411 of the case 41 has a larger curvature at both sidewalls (FIG. 4A) than at the bottom and top sections (FIG. 4B). As a result, there is an increased gap between the liner 43 and the case 41 along the sidewalls. More explosive material 42 can be placed there than at the top and bottom of the shaped charge. It is demonstrated in the earlier U.S. patent application Ser. No. 09/321,040, filed May 27, 1999, how this modification of the shaped charge leads to an elliptically shaped perforation hole.

Referring now to FIG. 5, a wellbore 50 is schematically illustrated. The wellbore traverses a hydrocarbon bearing formation 51 and is lined with casing tubulars 501 made of steel.

A perforation gun 52 is shown within the wellbore. The gun is suspended from a wireline 521. The perforation gun comprises modified shaped charges 52-1 to 52-9 of the type illustrated by FIG. 4. In contrast to the gun illustrated by FIG. 2, the modified shaped charges 52-1 to 52-9 generate elliptical perforation when oriented perpendicular to the wellbore axis. The vertical cross-section as shown in FIG. 5B has an elliptical circumference 512 with the major axis oriented perpendicular to the bedding plane. Again arrows are used to illustrate the flow into the perforation hole 511.

Major steps illustrating an application of a method according to the invention are shown in FIG. 6.

As a first step 61, the direction of minimal permeability of a hydrocarbon bearing formation is established using a suitable logging tool or method. Different methods such as core analysis and well testing or logging techniques can be used. Schlumberger™ offers a commercially available service for measuring vertical and horizontal permeability that uses a multi-probe wireline formation tester in the open hole before the casing and completion is run. Other tools to measure bedding planes are known in the art as dipmeter, microscanner or microimager.

Because of the empirical correlation between permeability and bedding plane, any tool that determines the latter could replace the above mentioned formation tester.

Once permeability is established and after any casing and/or completion operation necessary to isolate the hydrocarbon bearing formation, a perforation tool is lowered into the well on a wireline or on a coiled tubing in step 62. The tool is capable of generating perforation holes with an essentially elliptical cross-section through the casing and in the formation. After positioning the tool and orienting its elements (nozzles or shaped charges) such that the major axis of the generated holes coincides with the direction of minimal permeability, the tool is activated and the elliptical holes are created (Step 63). The subsequent procedure of producing oil or gas follows established practice.

Various embodiments of the invention have been described. The descriptions are intended to be illustrative of the present invention. It will be apparent to those skilled in the art that modifications may be made to the invention as described without departing from the scope of the claims set out below.

What is claimed is:

1. A method of preparing a wellbore for hydrocarbon production comprising the steps of:

in a hydrocarbon bearing formation, after determining the direction of minimal permeability, lowering a perforation tool into said wellbore; and activating said perforation tool to create perforation holes in the formation, said holes having a non circular cross-section with a major axis, wherein said major axis coincides with said direction of minimal permeability.

2. The method of claim 1 wherein the perforation holes have an essentially elliptical cross-section.

3. The method of claim 1 wherein the direction of minimal permeability is determined by using a dip meter or a resistivity micro formation tester.

4. The method of claim 1 wherein the perforation holes are created by a jet cutting tool.

5. The method of claim 1 wherein the perforation holes are created by a perforation gun using shaped charges.

6. The method of claim 5 wherein the shaped charges are asymmetric with respect to charge main axis.

7. The method of claim 1 wherein the perforation tool comprises a suspension member extending in operation from the surface to the tool body.

8. The method of claim 7 wherein the suspension member is a wireline or coiled tubing.

9. Perforation tool for preparing a wellbore for hydrocarbon production comprising:

a tool body; and a plurality of discharge elements being mounted on said tool body and adapted to create perforation holes in a hydrocarbon bearing formation surrounding said wellbore, said holes having a non circular cross-section with a major axis, wherein said major axis coincides with a direction of minimal permeability of said formation.

10. The perforation tool of claim 9 wherein the discharge elements are shaped charges being asymmetric with respect to charge main axis.

11. The perforation tool of claim 9 wherein the discharge elements are shaped charges having a case or liner with an elliptical cross-section.

12. The perforation tool of claim 9 wherein the discharge elements are adapted to create perforation holes with an essentially elliptical cross-section.

13. The perforation tool of claim 9 further comprising a suspension member extending in operation from the surface to the tool body.

14. The perforation tool of claim 13 wherein the discharge elements are nozzles.

15. The perforation tool of claim 13 wherein the suspension member is a wireline or coiled tubing.

16. The perforation tool of claim 9 wherein the discharge elements are shaped charges.

* * * * *